United States Patent [19]

Kim et al.

[11] 4,279,578

[45] Jul. 21, 1981

[54] COMPACT OIL SEPARATOR FOR ROTARY COMPRESSOR

[75] Inventors: Tong S. Kim, Arlington Heights; John S. Lee, Decatur, both of Ill.

[73] Assignee: Borg-Warner Corporation, Chicago, Ill.

[21] Appl. No.: 41,215

[22] Filed: May 21, 1979

[51] Int. Cl.[3] ..... F04C 29/02

[52] U.S. Cl. ..... 418/97; 418/DIG. 1

[58] Field of Search ..... 418/93, 97–100, 418/DIG. 1; 62/470, 473

[56] References Cited

U.S. PATENT DOCUMENTS

| | | | |
|---|---|---|---|
| 1,162,962 | 12/1915 | Wilson | 418/98 |
| 1,626,768 | 5/1927 | Vollmann | 418/98 |
| 3,312,387 | 4/1967 | Cassidy et al. | 418/97 |
| 3,385,513 | 5/1968 | Kilgore | 418/98 |
| 3,478,957 | 11/1969 | Harlin et al. | 418/89 |
| 3,684,412 | 8/1972 | Harlin et al. | 418/97 |
| 3,776,668 | 12/1973 | Abendschein | 418/97 |
| 3,877,853 | 4/1975 | Harlin | 418/93 |
| 4,071,306 | 1/1978 | Calabretta | 418/93 |

FOREIGN PATENT DOCUMENTS

| | | | |
|---|---|---|---|
| 116014 | 10/1942 | Australia | 418/97 |

*Primary Examiner*—John J. Vrablik
*Attorney, Agent, or Firm*—James E. Tracy

[57] ABSTRACT

Separation of lubricating oil, entrained in the discharge gas produced by a rotary vane compressor, is achieved in a relatively small space by initially passing the oil-laden discharge gas through a first closed chamber, containing an oil separating element, to form a stream of gas having some of its oil removed and having a desired velocity uniformly distributed across the stream's cross section. The gas stream is then circulated within a second and larger closed chamber where the remaining oil is separated out by gravity settling and impingement on the second chamber's walls. The separated oil collects in a reservoir at the bottom of the second chamber to form an oil pool. The oil-free discharge gas exits through an outlet in the second chamber. Oil is drawn off, and returned to the oil distribution system of the compressor, from a quiet portion of the oil pool which is protected from any turbulence of the gas stream by a shield within the second chamber that extends into the oil pool and prevents the re-entrainment of discharge gas, as gas bubbles, into the protected quiet portion of the pool. The shield also serves to prevent the protected oil from being re-entrained into the discharge gas.

6 Claims, 8 Drawing Figures

COMPACT OIL SEPARATOR FOR ROTARY COMPRESSOR

BACKGROUND OF THE INVENTION

This invention relates generally to an improved oil separator for a compressor, and more particularly to a compact oil separator which may be incorporated into a rotary sliding vane compressor especially adapted for use in an automotive air-conditioning system, and will be described in that environment.

In a rotary sliding vane compressor for an air-conditioning system lubricating oil is continuously needed to lubricate the moving components, to seal the high and low pressure sides of the compressor from each other, and, in some cases, to provide a cushion of pressurized oil underneath the vanes to urge the vanes toward the cylindrical wall of the compression chamber. This oil eventually leaves the compressor entrained in the refrigerant discharge gas and unless the oil is separated from the discharge gas and recirculated within the compressor the performance of the compressor as well as the air-conditioning system will be impaired. Specifically, if the compressor is deficient in oil the moving parts will be insufficiently lubricated and the required sealing between the high and low pressure sides will not be attained. In addition, substantial quantities of oil flowing out of the compressor with the refrigerant gas reduces the heat transfer in the condenser and evaporator.

Separation of oil from a gas is especially difficult when the density of the gas is very high, as may be the case with a compressor incorporated in an automotive air-conditioning system. The problem is additionally compounded, however, when it is desired to separate a large quantity of oil within a relatively small space, as is the case in an automotive rotary vane compressor. Re-entrainment of oil into the already-separated refrigerant gas and re-entrainment of refrigerant, as gas bubbles, into the already-separated oil is particularly difficult to avoid when the space limitations are severe. A still further complication to the problem arises when it is desired to achieve high oil separation efficiency throughout the compressor's speed range and at both low and high flow conditions.

The present invention overcomes this complex problem by providing a compact oil separator which requires very little space and may be integrated into a rotary vane compressor. Highly efficient oil separation is obtained at all flow conditions and at all compressor speeds, and yet there will be minimal, if any, re-entrainment of either the gas or oil into the other.

SUMMARY OF THE INVENTION

The present invention provides a compact oil separator for separating oil entrained in the discharge gas produced by a rotary compressor. The separator comprises means for providing a first closed chamber of relatively small volume and having an inlet and an outlet, an oil separating element being interposed in the chamber. There are means for providing a second closed chamber of relatively large volume and with an oil reservoir at the bottom thereof, the outlet of the first chamber communicating with the second chamber. Means are included for delivering the oil-laden discharge gas from the compressor into the first chamber and through the oil separating element to the second chamber whereupon the discharge gas flows turbulently within the second chamber and bounces off of the chamber's internal surface, the entrained oil impinging on the separating element and on the second chamber's internal surface to separate out from the discharge gas and drain into an oil pool in the reservoir. A shield, within the second chamber, protects and quiets a portion of the oil pool from the turbulent flow of the discharge gas to minimize the re-entrainment of oil into the discharge gas and to minimize the re-entrainment of discharge gas into the oil pool. There is a gas discharge outlet through which the separated, substantially oil-free discharge gas may exit from the second chamber. Finally, means are provided for supplying the separated, substantially gas-free oil from the protected quiet portion of the coil pool to the rotary compressor.

DESCRIPTION OF THE DRAWINGS

The features of the invention which are believed to be novel are set forth with particularity in the appended claims. The invention, together with further advantages and features thereof, may best be understood, however, by reference to the following description in conjunction with the accompanying drawings in which like reference numbers identify like elements, and in which:

DESCRIPTION OF THE PREFERRED EMBODIMENT

Figure 1:
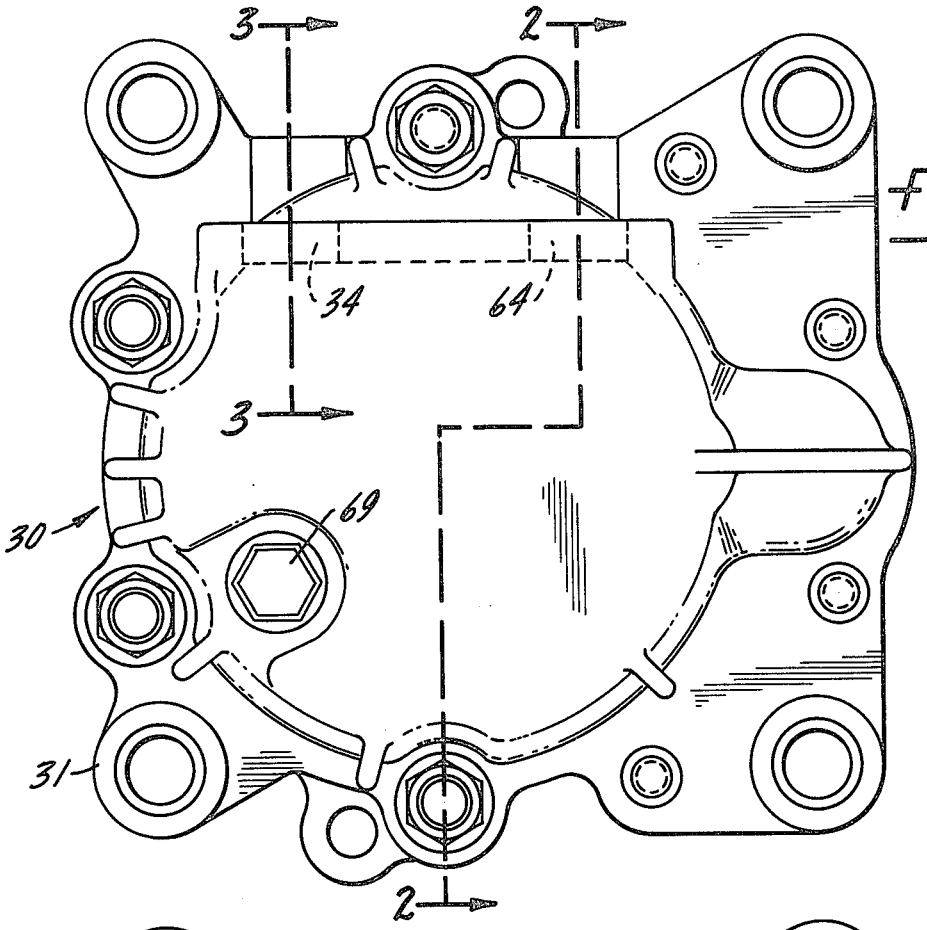
FIG. 1 is an end view of a rotary sliding vane compressor on which is mounted a compact oil separator constructed in accordance with the principles of the present invention.

The disclosed rotary compressor has a casing 10 which includes a cylinder structure 11 having a cylindrical bore or wall 12 extending therethrough, a front bearing plate 14, and a rear bearing plate 16, all secured together by a series of bolts and nuts. Casing 10 provides a closed cavity formed by cylindrical wall 12 and bearing plates 14 and 16 which serve as spaced parallel end walls for the cavity. The rotor assembly 20, eccentrically positioned within that cylindrical cavity, includes a slotted rotor 21 having a series of four slots 22 arranged circumferentially and each extending along a plane parallel to the rotor's axis. The closed end of each slot, for convenience, may be referred to as the bottom end. Each of a series of four reciprocating vanes 23 is slidably mounted in a respective one of slots 22. The eccentric positioning of rotor assembly 20 within cylindrical wall 12 is obtained by rotatably mounting rotor 21 on an axis offset with respect to the axis of wall 12. Such eccentric mounting creates a crescent-shaped compression chamber or cavity 24 between rotor 21, wall 12, and the two end walls or bearing plates 14 and 16.

Rotor 21 has a drive shaft 26 journalled in bearings 28 and 29 affixed to plates 14 and 16 respectively. The left end of shaft 26 (as viewed in FIG. 2) projects outwardly of front bearing plate 14 to facilitate driving of the shaft. Since the illustrated embodiment is especially adapted for automotive use, it is contemplated that a pulley and clutch mechanism (not shown) would be coupled to the left end of shaft 26 to permit the compressor to be driven by the engine fan belt or accessory drive belt of the automobile. Of course, the disclosed rotary compressor may be employed in many different environments and may be used in other than refrigeration or air-conditioning systems to compress a variety of different gaseous fluids. Whatever the driving means, it may conveniently be coupled to drive shaft 26.

Figure 4:
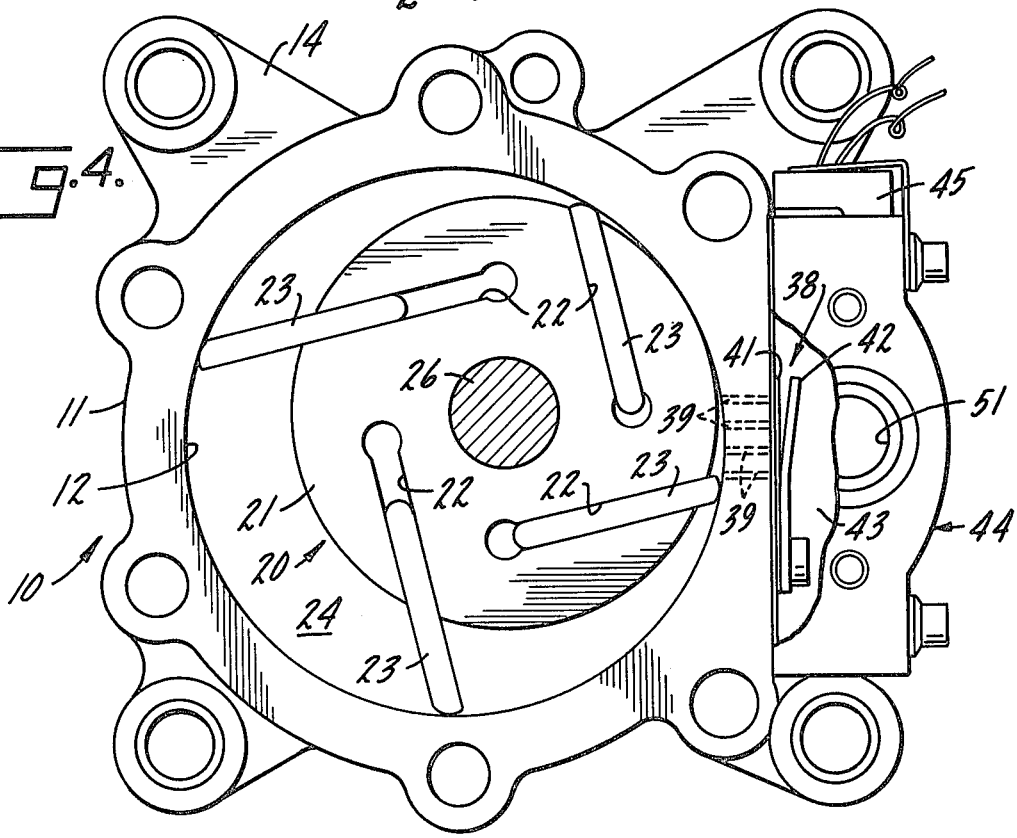
FIG. 4 is a cross-sectional view taken along the section line 4—4 in FIG. 2.
Figure 2:
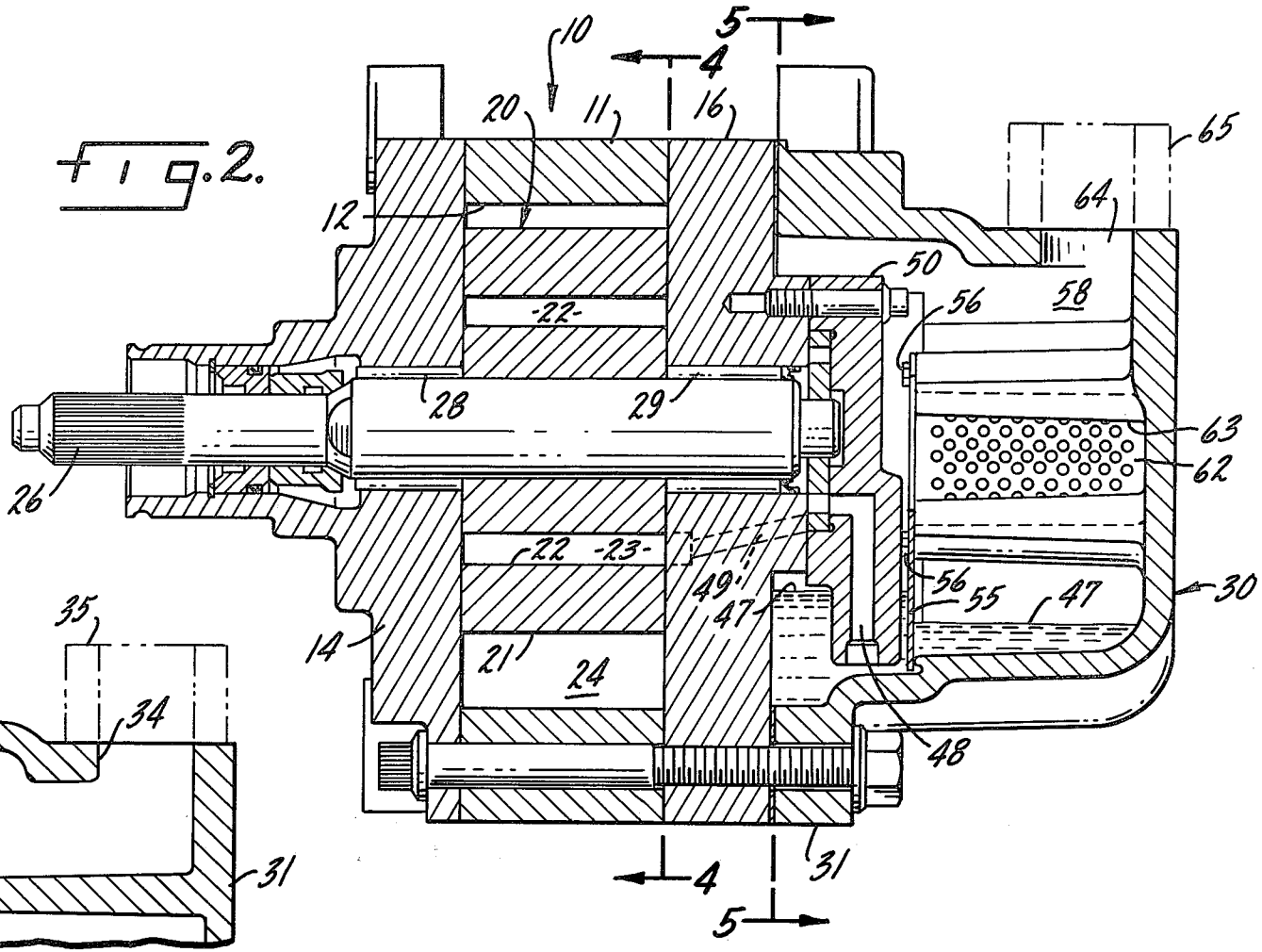
FIG. 2 is a cross-sectional view taken along the section line 2—2 in FIG. 1.
Figure 3:
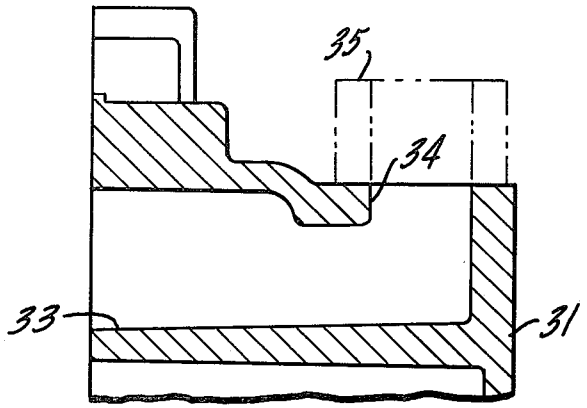
FIG. 3 is a fragmentary cross-sectional view taken along the section line 3—3 in FIG. 1.
Figure 8:
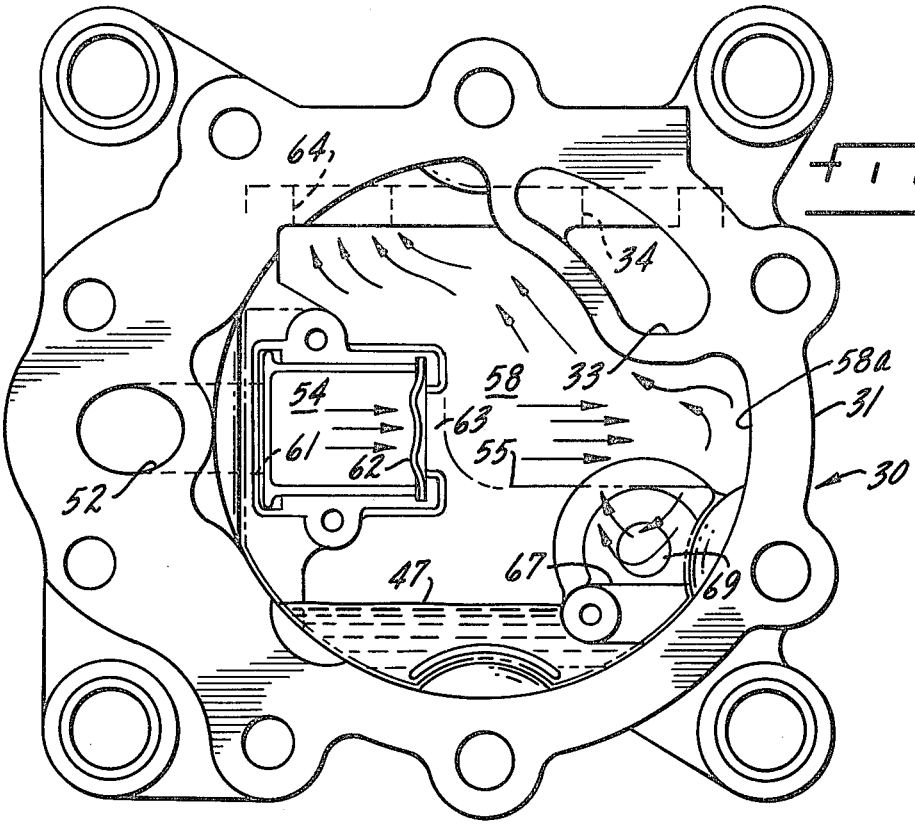
FIG. 8 is a view similar to FIGS. 5 and 6 and illustrates the flow path of the discharge gas in the oil separator.

The compressor is designed to operate when rotor assembly 20 revolves in a counter-clockwise direction as viewed in FIG. 4. Under all operating conditions, vanes 23 will be forced outwardly to their positions shown in FIG. 4 in order to firmly bear against cylindrical wall 12 and establish a fluid-tight, sealed connection thereto. A passageway is provided in the compressor from an inlet to enable the suction gas from the evaporator of the automotive air-conditioning system to reach the compression chamber 24. More specifically, the portion of the compressor illustrated to the right of and including bearing plate 16 in FIG. 2 may be termed the oil sump assembly and is designated by the reference number 30. Parts of assembly 30 are also shown in FIGS. 5–8. As will be explained in detail later, it is in the oil sump assembly 30 where the oil separation takes place in accordance with the principles of the invention. The basic component of assembly 30 is a cast housing or casting 31 (preferably die-cast aluminum) and, as shown in FIGS. 3 and 8, a conduit 33 is formed in the casting from a suction port 34. Shown in dashed line construction in FIG. 3 is a connector 35 to facilitate a more convenient coupling to the evaporator. The open end of conduit 33, on the left in FIG. 3, is generally kidney-shaped (see FIGS. 5, 6 and 8) and mates with a corresponding kidney-shaped opening (not shown) that extends through bearing plate 16 and communicates with the suction portion of crescent-shaped compression cavity 24, namely the upper portion of cavity 24 as view in FIG. 4.

A passageway is thereby established from suction port 34 to allow suction gas to flow into the suction portion of compression chamber 24. As rotor 21 is rotated counterclockwise (as viewed in FIG. 4), the suction gas is trapped between two adjacent vanes 23 and carried forward toward the discharge area. As this occurs, the volume between the adjacent vanes is reduced thereby resulting in a corresponding increase in pressure of the gas. A discharge valve assembly 38 is located in the discharge zone for assuring proper compression of the gases issuing from a series of outlet or discharge ports 39, bored in cylinder structure 11, and for preventing reverse flow of gases back into compression cavity 24. The valve assembly is of the reed type comprising a series of valve reeds 41 each of which is held in place by a respective one of a series of valve guards or stops 42. Only one reed 41 and one stop 42 is shown in FIG. 4. The compressed gaseous refrigerant emanating from ports 39 flows into a chamber 43 in a discharge gas plenum 44. Device 45, mounted on plenum 44, is a thermal protector which interrupts the clutch electrical circuit if the compressor is operated with insufficient refrigerant charge. The thermal protector includes a temperature sensitive fuse and monitors the discharge gas temperature in chamber 43, disengaging the clutch if that temperature exceeds a predetermined level.

Oil is supplied to all of the moving components and bearing surfaces to provide proper lubrication and to seal the high and low pressure sides of the compression cavity from each other. In addition, oil is delivered to the bottom ends of slots 22 to force vanes 23 outwardly and toward wall 12. In the illustrated embodiment, a pressure differential lubrication system is employed. More particularly, the oil sump is located on the discharge side of the compressor so that the oil pressure is essentially equal to the compressor discharge pressure. Hence, lubricating oil will flow through oil passages to the interior of the compressor which is lower in pressure than the oil pressure. Oil from oil pool 47, which lies in an oil reservoir at the bottom of the oil sump assembly 30, therefore flows through oil passage 48 in oil metering assembly 50, passage 49 in bearing plate 16, and other passages not specifically shown, to all of the surfaces requiring lubricating and sealing and to the underside of vanes 23. Preferably, metering assembly 50 will also serve to restrict the reverse flow of oil. Assembly 50 may be constructed in accordance with the teachings of U.S. Pat. No. 4,071,306 which issued on Jan. 31, 1978 in the name of Peter T. Calabretta.

The high pressure discharge gas flowing through valve assembly 38 and into chamber 43 will therefore be heavily laden with oil. This entrained oil must be removed from the discharge gas because substantial quantities of oil in the discharge gas reduce the heat transfer in the condenser and evaporator. In addition, it is much more difficult to supply a sufficient amount of oil to the compression chamber to attain the necessary sealing between the rotor and chamber surfaces if the oil is allowed to circulate around the system.

Figure 5:
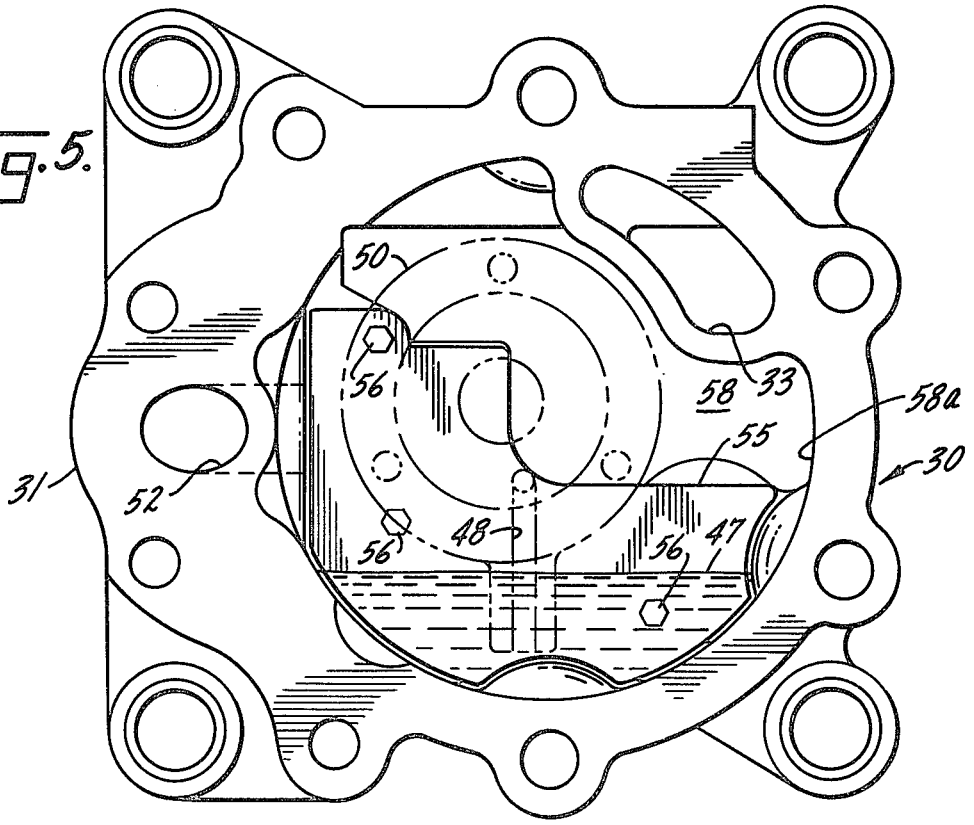
FIG. 5 is a cross-sectional view taken along the section line 5—5 in FIG. 2, with some of the parts omitted for clarity.
Figure 6:
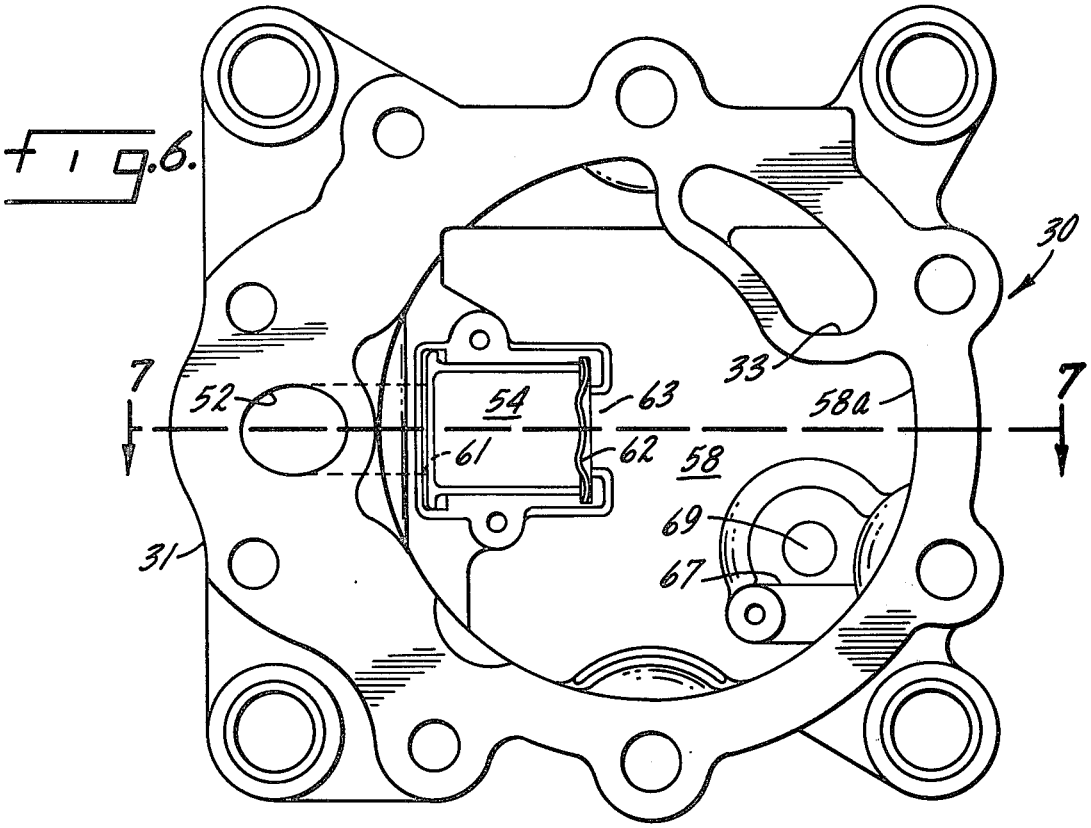
FIG. 6 is a cross-sectional view similar to FIG. 5 with additional parts deleted in order to facilitate a better understanding of the invention.
Figure 7:
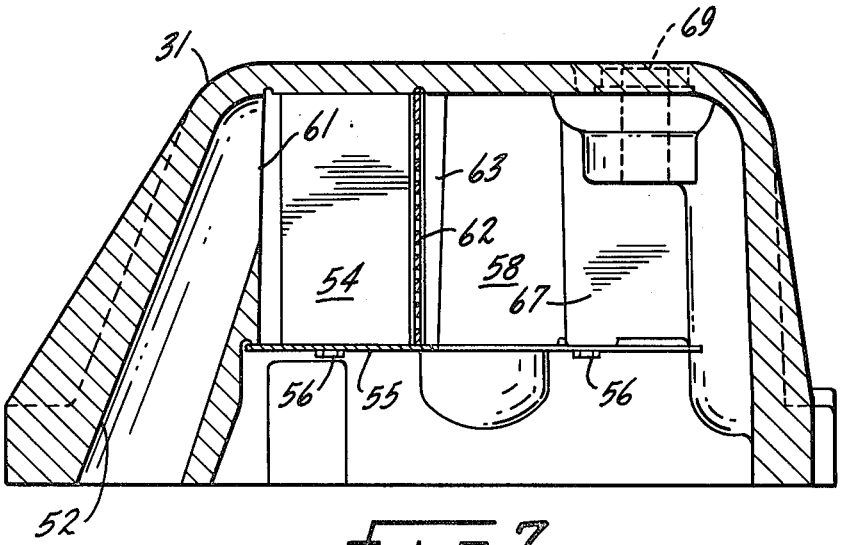
FIG. 7 is a cross-sectional view taken along the section line 7—7 in FIG. 6.

Oil separation, in accordance with the invention, takes place within oil sump assembly 30. The oil-laden discharge gas from the rotary compressor is delivered into assembly 30 via a passageway which includes port 51 in plenum 44, a port (not shown) bored through bearing plate 16, and a conduit 52 (see FIGS. 5–8) formed in casting 31. Assembly 30 is constructed to have two fluid-tight closed chambers. A first relatively small chamber 54 is defined primarily by walls formed in casting 31. One wall of chamber 54, however, is provided by a shield in the form of a flat plate 55 which is rigidly affixed to the casting by the three screws 56 (see FIGS. 2, 5 and 7). In FIG. 6, oil sump assembly 30 is shown with shield 55 removed while in FIG. 8 the shield is shown in phantom construction. The second closed fluid-tight chamber 58 in assembly 30 is much larger than chamber 54 and is formed by casting 31, oil metering assembly 50 (shown in phantom in FIG. 5) and one side of bearing plate 16. Chamber 58 also includes the oil reservoir, at the bottom of casting 31, which contains the oil pool 47. As seen in FIG. 2, the level of oil pool 47 is lower behind plate 55 (to the right of the plate in FIG. 2) than in front (or left) of the plate. The oil pool level in the back is shown in FIG. 8, whereas the front pool level is illustrated in FIG. 5.

The inlet 61 of chamber 54 (best shown in FIGS. 6–8) communicates with conduit 52 to permit the oil-laden discharge gas to flow into the chamber. An oil separating medium or element 62 is interposed in the outlet 63 of chamber 54, the outlet communicating with the large chamber 58. As illustrated, separator 62 takes the form of a perforated baffle plate. Any appropriate gas permeable, oil separating element may be employed, however. For example, a layer of coarse mesh woven metal ribbons may be used. As another example, a series of staggered channels will provide the required oil separation. Moreover, the oil separating element need not be located at the outlet 63. Instead, it may be inserted within chamber 54.

In the operation of the oil separator, the discharge gas, together with the oil entrained therein, flows through passageway 52 and into chamber 54 where its velocity is reduced since the gas is flowing and expanding into a larger volume. The oil particles, having more momentum than the gas, collide with each other and then impinge on separating medium 62, thereby separating from the discharge gas and draining into oil pool 47. The gas, with any remaining entrained oil, passes through separator 62 and outlet 63 and into the much larger chamber 58. In addition to accomplishing oil separation by impingement, separating element 62 also distributes the gas stream uniformly over the exit area of chamber 54 by presenting a substantial and uniformly distributed flow resistance. Chamber 54 and separating element 62 are so constructed and dimensioned that the gas stream, exiting at outlet 63, will have a desired velocity uniformly distributed across the stream's cross section. The gas stream is then circulated within chamber 58 where the gas strikes and bounces off of the chamber's walls, the remaining entrained oil separating out by gravity settling and impingement and running into oil pool 47. The gas circulates around chamber 58 at a desired velocity and travels a relatively long flow path, thereby maximizing the amount of separation by impingement on the chamber's walls and by gravity settling. The general flow path of the gas in chamber 58 is illustrated by the arrows in FIG. 8. A gas discharge outlet or port 64 (see FIGS. 1, 2 and 8) is provided in casting 31 to permit the separated, substantially oil-free discharge gas to flow out of chamber 58. Coupling 65, shown in dashed line construction in FIG. 2, may be employed to facilitate a more convenient connection to the condenser in the air-conditioning system.

Maximizing the length of the flow path within the limited confines of chamber 58 is aided by positioning chamber 54 and separator 62 so that the gas stream formed thereby is aimed at portion 58*a* of the internal surface of chamber 58. Note that both outlet 63 and surface portion 58*a* are generally planar and are parallel to each other. As a result, at least some of the discharge gas flowing out of chamber 54 flows toward and impinges on surface portion 58*a* and then bounces back and flows in the opposite direction thereby following a hairpin-shaped flow path before the gas eventually flows upward and exits through outlet 64. By initially following the hairpin-shaped route, the length of the flow path is increased as a consequence of which the amount of gravity settling of the oil is increased. Moreover, since the return stream (namely, that bouncing off of surface portion 58*a*) will be above the direct stream, oil from the return stream will drop onto the direct stream and will be hurled against the chamber wall repeatedly, thereby improving the separation.

The velocity of the gas sweeping over oil pool 47, though chosen to be optimum, is nevertheless relatively high because of the space limitations within chamber 58. As a result, the gas flow within chamber 58 will usually be highly turbulent. This creates a problem of gas being entrained in the oil pool as bubbles and of once-separated oil being re-entrained into the gas stream. To resolve this problem, shield or plate 55 is provided within chamber 58. The shield functions to protect and quiet a portion of the oil pool from the turbulent flow of the discharge gas to minimize the re-entrainment of oil into the discharge gas and to minimize the re-entrainment of discharge gas into the oil pool. To explain, shield 55 extends from well above and through the oil pool down to substantially the bottom of the oil reservoir. During normal operation, namely when the vehicle in which the compressor is mounted is substantially level, the plane of plate 55 is generally perpendicular to the surface of oil pool 47. The top portion of plate 55 which serves as one wall of chamber 54 provides a fluid-tight seal since it is desirable that all of the oil-entrained discharge gas flows into chamber 54 and out through oil separating element 62. If any gas leaks out of chamber 54, around the portion of plate 55 that covers the chamber, the discharge gas may re-entrain as gas bubbles into the already-separated oil. In the absence of a tight seal, gas leaks would occur since the flow resistance of oil separating element 62 produces a substantial pressure difference between the inside and outside of chamber 54. On the other hand, there should be a small clearance gap between a portion of the lower edge of plate 55 and the bottom of the oil reservoir to permit oil flow from behind plate 55 (or from the right side of plate 55 as viewed in FIG. 2) to the front (or to the left side) of the plate. The oil withdrawn through passage 48 in front of plate 55 is replaced by oil that flows from behind the plate and through the narrow clearance gap. At the same time, plate 55 provides an oil seal along the plate's lower edge to prevent the discharge gas from flowing directly through the portion of the oil pool in front of plate 55 and re-entraining therein as gas bubbles.

With this arrangement, the turbulent action of the discharge gas in chamber 58 is confined to the space behind plate 55 so that the turbulently flowing gas cannot stir, churn or agitate the portion of the oil pool in front of plate 55 where the oil is drawn off through the pick-up tube containing passage 48 and delivered to the oil distribution system. Hence, the oil in front of plate 55 is effectively made a protected quiet or quiescent portion of the oil pool. Two desirable results are achieved. By preventing the gas from flowing through the quiet portion of the pool, the gas cannot re-entrain as gas bubbles into the already-separated oil. Secondly, by preventing the turbulent gas from reaching the surface of the quiet portion of the pool, oil from that quiet portion cannot re-entrain into the discharge gas. As shown in FIG. 2, the level of the front quiet portion of pool 47 is higher than the back portion. This occurs because the turbulence probably increases the pressure behind plate 55 relative to the pressure in front.

It is to be noted that the height of plate 55 above the surface of pool 47 is limited in order to maximize the space in chamber 58 through which the discharge gas flows, while at the same time providing the desired isolation of the quiet portion of the pool from the turbulence of the gas flow.

A shelf or partition 67, formed in casting 31 (see FIGS. 6–8), is positioned above the unprotected portion of the oil pool for deflecting the turbulent gas flow away from the oil pool to minimize the re-entrainment of oil, from the unprotected portion of the pool, into the discharge gas.

Hence, with the compact oil separator of the invention, which requires relatively little space compared to the previously developed oil separators, substantially oil-free discharge gas will exit from chamber 58 through outlet 64 and substantially gas-free oil will be drawn (through oil passage 48) from the bottom of the protected quiet portion of oil pool 47 and conveyed to the rotary compressor.

Bolt 69 (see FIGS. 6–8) is an oil filler plug to facilitate filling of the oil reservoir with the desired quantity of oil.

As illustrated, bearing plates 14 and 16 and casting 31 include several openings (unnumbered in the drawings) for accommodating bolts for securely mounting the rotary compressor in a vehicle. For normal installation, the compressor will have the attitude shown in the drawings, namely, suction port 34 and discharge port 64 being vertical. The compressor will function properly, however, even if it is mounted in a substantially tilted position in either direction from the normal position.

While a particular embodiment of the invention has been shown and described, modifications may be made, and it is intended in the appended claims to cover all such modifications as may fall within the true spirit and scope of the invention.

We claim:

1. A compact oil separator for separating oil entrained in the discharge gas produced by a rotary compressor, the separated oil forming an oil pool, comprising:

means for providing a first closed chamber of relatively small volume and having an inlet and an outlet which is generally planar and perpendicular to the surface of the oil pool;

a relatively small, generally planar gas permeable, oil separating element interposed in, and parallel to, the outlet of said first chamber;

means for providing a second closed chamber of relatively large volume, much greater than the volume of said first closed chamber, and with an oil reservoir for the oil pool at the bottom thereof, the planar outlet of said first chamber communicating with said second chamber, a predetermined portion of the second chamber's internal surface being generally planar and parallel to the plane of, and directly opposite from, the first chamber's outlet;

means for delivering the oil-laden discharge gas from the compressor into said first chamber at a relatively high velocity and against and through said oil separating element to said second chamber whereupon the discharge gas flows turbulently within said second chamber and bounces off of the chamber's internal surface, wherein at least some of the discharge gas flowing out of said first chamber flows horizontally in one direction, parallel to the surface of the oil pool, and impinges on said predetermined surface portion of said second chamber and then bounces back and flows in the opposite direction thereby following a hairpin-flow path, the entrained oil in the discharge gas separating out by gravity settling and by impinging on said oil separating element and on the second chamber's internal surface and draining into the oil pool in said reservoir;

a planar shield, within said second chamber and perpendicular to the surface of the oil pool and extending from above and into the oil pool and almost to the bottom of the reservoir thereby dividing a small clearance gap, for protecting and quieting a portion of the oil pool from the turbulent flow of the discharge gas to minimize the re-entrainment of oil into the discharge gas and to minimize the re-entrainment of discharge gas into the oil pool, the top of said planar shield being a substantial distance from the top of said second chamber to maximize the space in the second chamber through which the discharge gas flows while at the same time providing the desired isolation of the quiet portion of the oil pool from the turbulence of the gas flow, the small clearance gap permitting oil flow to the protected portion of the oil pool while providing an oil seal along the shield's lower edge to prevent the discharge gas from flowing directly through the protected oil and re-entraining therein as gas bubbles;

a gas discharge outlet through which the separated, substantially oil-free discharge gas may exit from said second chamber;

and means for supplying the separated, substantially gas-free oil from the protected quiet portion of the oil pool to the rotary compressor.

2. A compact oil separator for a rotary sliding vane compressor having a compression cavity, suction and discharge ports communicating with the cavity, a rotor in the cavity adapted to compress a gaseous refrigerant introduced through the suction port and to discharge that gas, together with lubricating oil entrained therein, at a higher pressure through the discharge port, the separated oil forming an oil pool, comprising:

an oil sump assembly having means defining a first fluidtight, relatively small closed chamber with an inlet on one side and a planar outlet, across which a generally planar gas permeable oil separating medium is provided, on the opposite side, both the outlet and the oil separating medium being perpendicular to the surface of the oil pool;

a conduit for communicating the discharge port of the compression cavity with the inlet of said first chamber to deliver the high-pressure, oil-laden discharge gas into said first chamber at a relatively high velocity and against and through said oil separating medium, at least some of the entrained oil being separated from the discharge gas by said medium and draining into the oil pool which is provided by a reservoir at the bottom of said oil sump assembly;

means, in said oil sump assembly, defining a second fluidtight closed chamber, which includes said oil reservoir and is substantially larger in volume than said first chamber, for receiving the discharge gas flowing through said oil separating medium, the discharge gas flowing turbulently within said second chamber and impinging on the chamber's internal surface whereby the remaining oil entrained in the gas separates out from the discharge gas by impingement and gravity settling and drains into the oil pool, a predetermined portion of the second chamber's internal surface being generally planar and parallel to the plane of, and directly opposite from, the first chamber's outlet, at least some of the discharge gas flowing out of said first chamber flowing horizontally in one direction, parallel to the surface of the oil pool, and impinging on said predetermined surface portion and then bouncing back and flowing in the opposite direction thereby following a hairpin-shaped flow path;

a plate, within said second chamber and perpendicular to the surface of the oil pool and extending from above and down into the oil pool to substantially the bottom of said reservoir thereby providing a small clearance gap, for protecting and quieting a portion of the oil pool from the turbulent flow of the discharge gas to prevent the re-entrainment of oil, from the protected quiet portion of the pool, into the discharge gas and also to prevent the re-entrainment of discharge gas, as gas bubbles, into the oil in the quiet portion of the oil pool, the height of said plate, above the surface of the oil pool, being limited to maximize the space in the second chamber through which the discharge gas flows, while at the same time providing the desired isolation of the quiet portion of the oil pool from the turbulence of the gas flow, extending said plate to almost the bottom of said reservoir preventing the turbulent action of the discharge gas from churning and agitating the protected quiet portion of the oil pool, while at the same time preventing the discharge gas from flowing into and through the protected quiet portion of the oil pool;

a gas discharge outlet through which the separated, substantially oil-free discharge gas may exit from said second chamber;

and an oil supply passageway for conveying the separated, substantially gas-free oil from the protected quiet portion of the oil pool to the rotary compressor.

3. A compact oil separator according to claim 2 wherein said oil separating medium is a perforated baffle plate.

4. A compact oil separator according to claim 2 and including a partition positioned above the unprotected portion of the oil pool for deflecting the turbulent gas flow away from the oil pool to minimize the re-entrainment of oil, from the unprotected portion of the pool, into the discharge gas.

5. A compact oil separator according to claim 2 wherein said plate also forms one of the walls for said first closed chamber.

6. A compact oil separator according to claim 2 wherein said oil sump assembly includes a casting which forms a major portion of the wall area for both of said closed chambers.

* * * * *